US007621060B2

(12) United States Patent
Waterhouse

(10) Patent No.: US 7,621,060 B2
(45) Date of Patent: Nov. 24, 2009

(54) ADVERTISING SUPPORT WITH ILLUMINATED MAGNIFIER

(76) Inventor: William H. Waterhouse, P.O. Box 722274, Norman, OK (US) 73070

( * ) Notice: Subject to any disclaimer, the term of this patent is extended or adjusted under 35 U.S.C. 154(b) by 1059 days.

(21) Appl. No.: 10/982,964

(22) Filed: Nov. 5, 2004

(65) Prior Publication Data

US 2006/0096140 A1 May 11, 2006

(51) Int. Cl.
*G09F 15/00* (2006.01)

(52) U.S. Cl. ..... 40/606.01; 40/761; 40/607.01; 40/611.11; 248/188.8

(58) Field of Classification Search ..... 40/606.01, 40/761, 607.01, 606.18, 611.01, 611.13, 40/666, 661; 248/188.8
See application file for complete search history.

(56) References Cited

U.S. PATENT DOCUMENTS

| | | | | |
|---|---|---|---|---|
| 1,857,552 | A * | 5/1932 | Komorous | 248/473 |
| 2,056,693 | A | 10/1936 | Stanley | |
| 2,236,888 | A * | 4/1941 | Bishop | 40/611.01 |
| D146,272 | S | 1/1947 | Van Dyke | |
| 2,527,071 | A | 10/1950 | Pierce | |
| 2,557,398 | A * | 6/1951 | Teetor | 40/124.04 |
| 2,557,399 | A * | 6/1951 | Teetor | 40/124.04 |
| 2,736,097 | A | 2/1956 | Coleman | |
| 2,767,497 | A | 10/1956 | Munson | |
| 3,039,350 | A | 6/1962 | Gollhofer | |
| D221,161 | S | 7/1971 | Lynch | |
| D350,566 | S | 9/1994 | Pearson | |
| 5,457,613 | A | 10/1995 | Vandenbelt et al. | |
| D375,980 | S | 11/1996 | Current | |
| D383,497 | S | 9/1997 | Robertson | |
| D390,271 | S | 2/1998 | Wolff | |
| 5,757,560 | A | 5/1998 | Fisherman | |
| 5,857,791 | A * | 1/1999 | Kenney | 400/718 |
| D407,119 | S | 3/1999 | Kwan | |
| D409,664 | S | 5/1999 | Perrin et al. | |
| 5,943,173 | A | 8/1999 | Waterhouse | |
| D424,618 | S | 5/2000 | Waterhouse | |
| 6,081,393 | A * | 6/2000 | Waterhouse | 359/802 |
| D445,837 | S | 7/2001 | Waterhouse | |

OTHER PUBLICATIONS

Snaptron RK-Series, Snaptron, Inc., Sep. 21, 2004, p. 1-2.

Torrens, Richard, 4 QD-TEC: Electronics Circuits Reference Archive Touch Operated switches, Sep. 21, 2004, p. 1-5.

111SM2-T, Honeywell, Inc., Sep. 21, 2004, p. 1-4.

11SX21-T, Honeywell, Inc., Sep. 21, 2004, p. 1-4.

Discover Circuits-Capacitance / Touch Switch Circuits, Discover Circuits, Sep. 21, 2004, p. 1-2.

Electromechanical E-Switch at Mouse.com, Mouser Electronics, Inc., Sep. 21, 2004, p. 1-2.

(Continued)

*Primary Examiner*—Robert J. Sandy
*Assistant Examiner*—Marcus Menezes
(74) *Attorney, Agent, or Firm*—James T. Robinson; Exclusiviry-Law, Inc.

(57) ABSTRACT

A table-top advertising support with illuminated magnifier includes a taller section containing a fresnel lens and a lamp-switch-battery assembly in a lower portion and an upper portion having vertically aligned elongated slots formed by cooperation of staggered opposing tabs. The taller section is attached to a shorter section containing a second fresnel lens disposed within a frame.

17 Claims, 13 Drawing Sheets

OTHER PUBLICATIONS

STSM—Ultraminiature Tactile Switch, Bourns, Oct. 2002.
Snaptron BL-Series, Snaptron, Inc., Sep. 21, 2004, p. 1-2.
Snaptron F-Series, Snaptron, Inc., Sep. 21, 2004, p. 1-2.
320.01 E1-1 BLU, E-Switch, Feb. 26, 2003.
Johnson, Dave, Touch Activate Switch Self-Excited, 5V Supply, Momentary Operation, Jul. 8, 2000.
Johnson, Dave, Finger Activated Switch Circuit, Jun. 3, 2000.
Snaptron P-Series, Snaptron, Inc., Sep. 21, 2004.
320.02 E1-1 (w/.09 GRY), E-Switch, Jun. 13, 2002.
BulbCo—Miniature lamps, Light Bulbs Ent, Sep. 21, 2004, p. 1-2.
L200CWXKB-12D, Ledtronics, Inc., Oct. 1, 2001.
SPL300CWXXK, Ledtronics, Inc., Aug. 16, 2002.
White Discrete LEDs: SMT, T1 (3mm), T1 ¾ (5mm), 10mm, Rectangular, Ledtronics, Inc., Sep. 21, 2004.
6mm Square Low-profile Double Action Type TACT Switch, SKRN Series, ALPS, p. 361.
Snaptron E-Series, Snaptron, Inc., Sep. 21, 2004.
FAI: Metal Dome Switch Assemblies for Mobile Phones, Fujikura America, Inc., Sep. 21, 2004, p. 1-2.
6.2×6.5mm Square Type TACT Switch, SKHM Series, ALPS, p. 364.
5.9×6mm Low-contact Resistance Type TACT Switch, SKPM Series, ALPS, p. 390.
4.5mm Square Low-profile Type TACT Switch, SKRM Series, ALPS, p. 355.
7.5mm×7mm Low-profile and Long-life Type TACT Switch, SKRR Series, ALPS, p. 369.

* cited by examiner

ADVERTISING SUPPORT WITH ILLUMINATED MAGNIFIER

BACKGROUND OF THE INVENTION

1. Background

This invention provides a table-top advertising support which includes an illuminated magnifier. The invention is also referred to herein, from time to time, as a table topper.

2. Discussion

Restaurants commonly use table-top advertising supports to provide information to diners. The information may relate to business hours, new dishes, or beverage promotions. Restaurants are often dimly lit, so diners may have difficulty reading either the menu or, more frequently, the sales slip (also referred to herein as the check) presented for payment following completion of a meal.

Applicant's improved advertising support with a diner-activated illuminated magnifier (table topper) is adapted for a low cost of manufacture, thereby facilitating a restaurant supplier's furnishing the advertising support with illuminated magnifier along with the supplier's advertising materials.

As used herein, the term "advertising" or "information" includes, without limitation, advertisements/pricing for food and beverages, emergency numbers, sayings, news of coming events/specials, or any other visual material.

SUMMARY OF THE INVENTION

A table-top advertising support with illuminated magnifier includes a taller section containing a fresnel lens and a lamp-switch-battery assembly in a lower portion and an upper portion having vertically aligned elongated slots formed by cooperation of staggered opposing tabs. The taller section is attached to a shorter section containing a second fresnel lens disposed within a frame.

DETAILED DESCRIPTION

Figure 1:
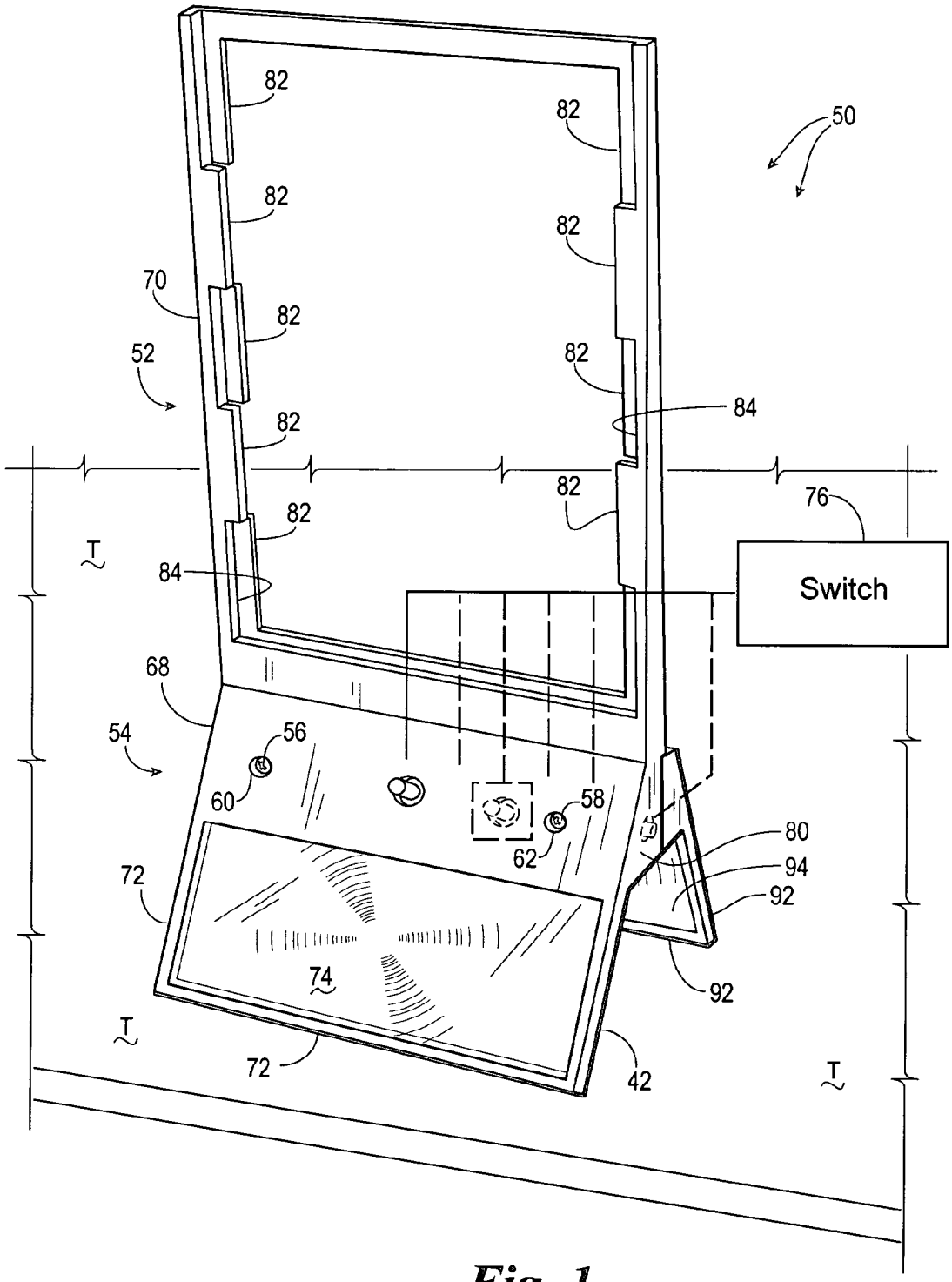
FIG. 1 shows the advertising support with illuminated magnifier of the present invention wherein the two mating sections are assembled.

In the following description of the of the present invention, like numerals and characters designate like elements throughout the figures of the drawings.

Referring generally to the drawings and more particularly to FIGS. 1–5, a table topper 50 includes a taller section 52 and a shorter section 54. As shown more clearly in FIGS. 3–4, screws 56, 58 disposed in bores 60, 62 in the taller section 52 engage receiving bores 64, 66 in the shorter section 54.

Referring now to FIG. 1, the taller section 52 includes a lower portion 68 and an upper portion 70. A frame 72 in the lower portion 68 houses an integrally molded fresnel lens 74. A switch 76 located above the frame 72 in the lower portion 68 actuates a lamp 78 (see FIG. 5). The lower portion 68 of the taller section 52 includes an end panel 80. As illustrated by the phantom lines and the phantom switches in FIG. 1, the switch 76 can be located at any convenient location.

The switch shown in FIG. 1 is a common momentary micro switch. It will be understood by one skilled in the art that various types of switches can be utilized according to applicant's invention. Tactile switches, micro switches, Faraday switches, roller lever switches, and thermal touch switches (referred to herein, collectively, as touch switches) are known in the art and suitable for use in applicant's table topper 50 (see FIG. 9).

Figure 5:
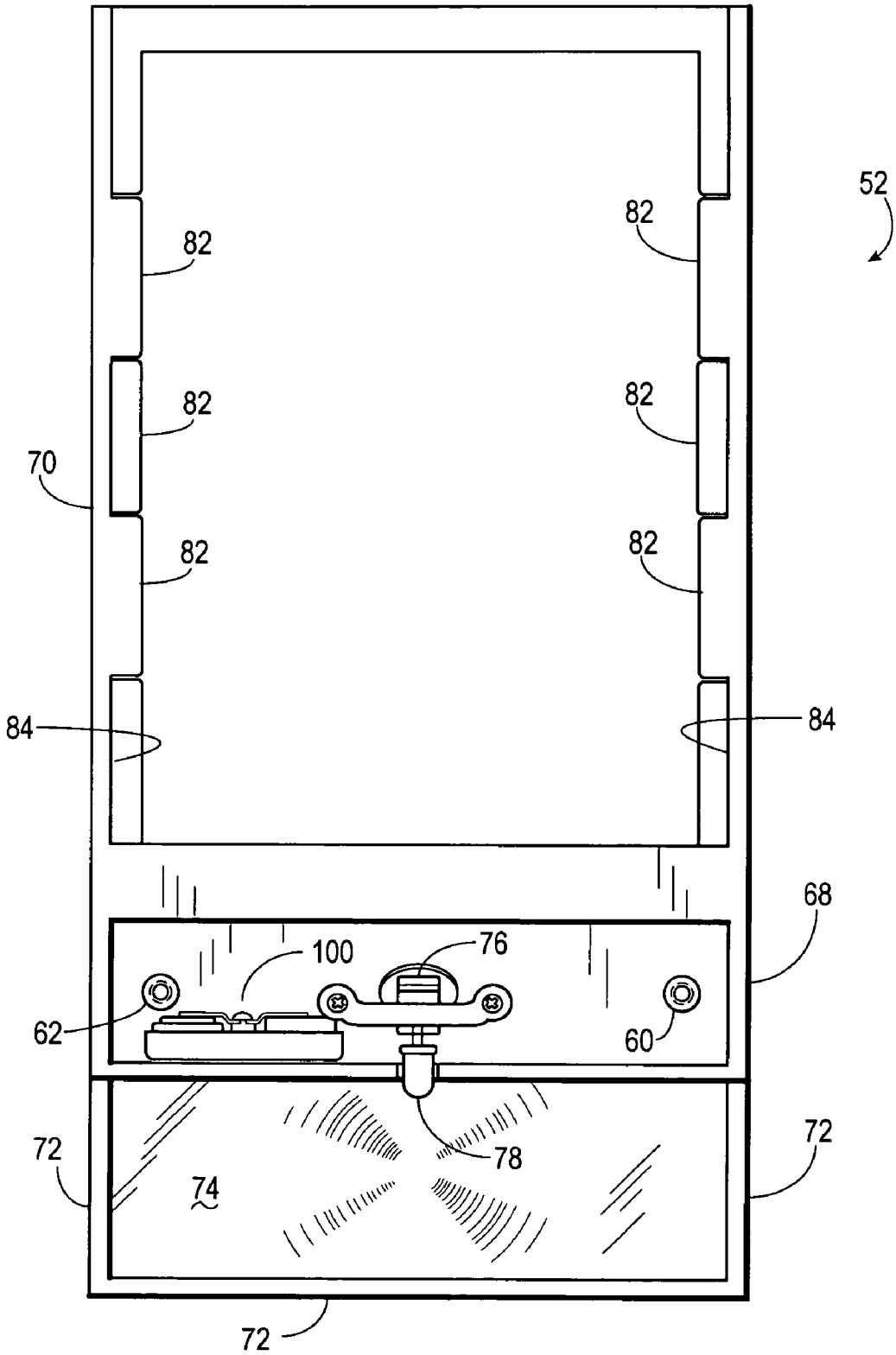
FIG. 5 is another view of the table topper shown in FIG. 1.

It will be further understood by one skilled in the art that, while the lamp 78 in FIG. 5 is a light emitting diode (LED), any convenient lamp can be used including, without limitation, incandescent bulbs and halogen lamps.

Figure 2:
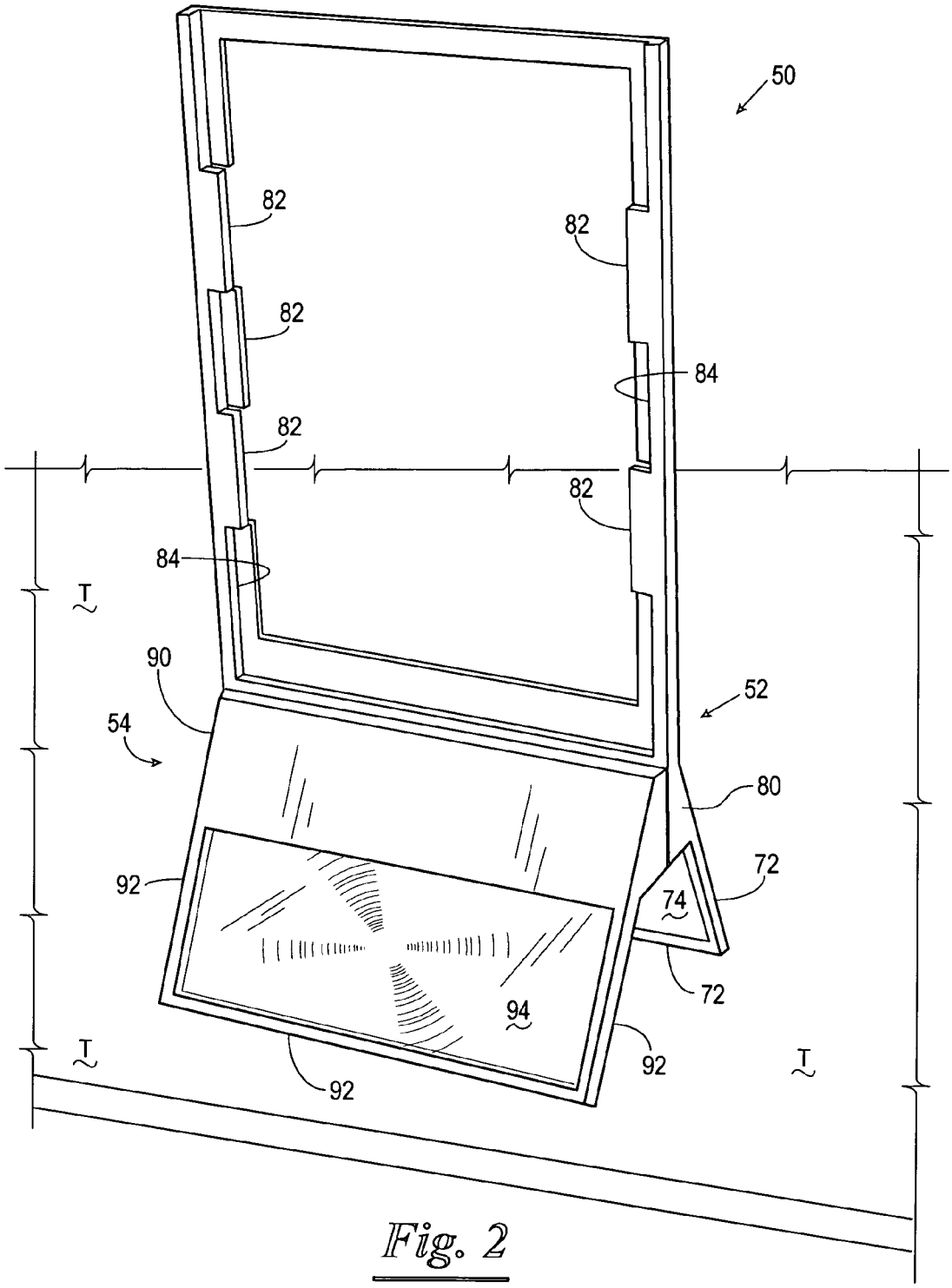
FIG. 2 is another view of the lower portion of the table topper shown in FIG. 1, wherein the two mating sections are exploded away from each other.

Referring now to FIGS. 1, 2, and 5, staggered opposing tabs 82 in the upper portion 70 of the taller section 52 cooperate to form a pair of vertically aligned elongated slots 84. The vertically aligned elongated slots 84 are adapted to receive advertising or other informational material to be displayed in the table topper 50.

Referring now to FIGS. 1–2, the shorter section 54 includes an upper portion 90 and a frame 92 surrounding an integrally molded fresnel lens 94.

Figure 3:
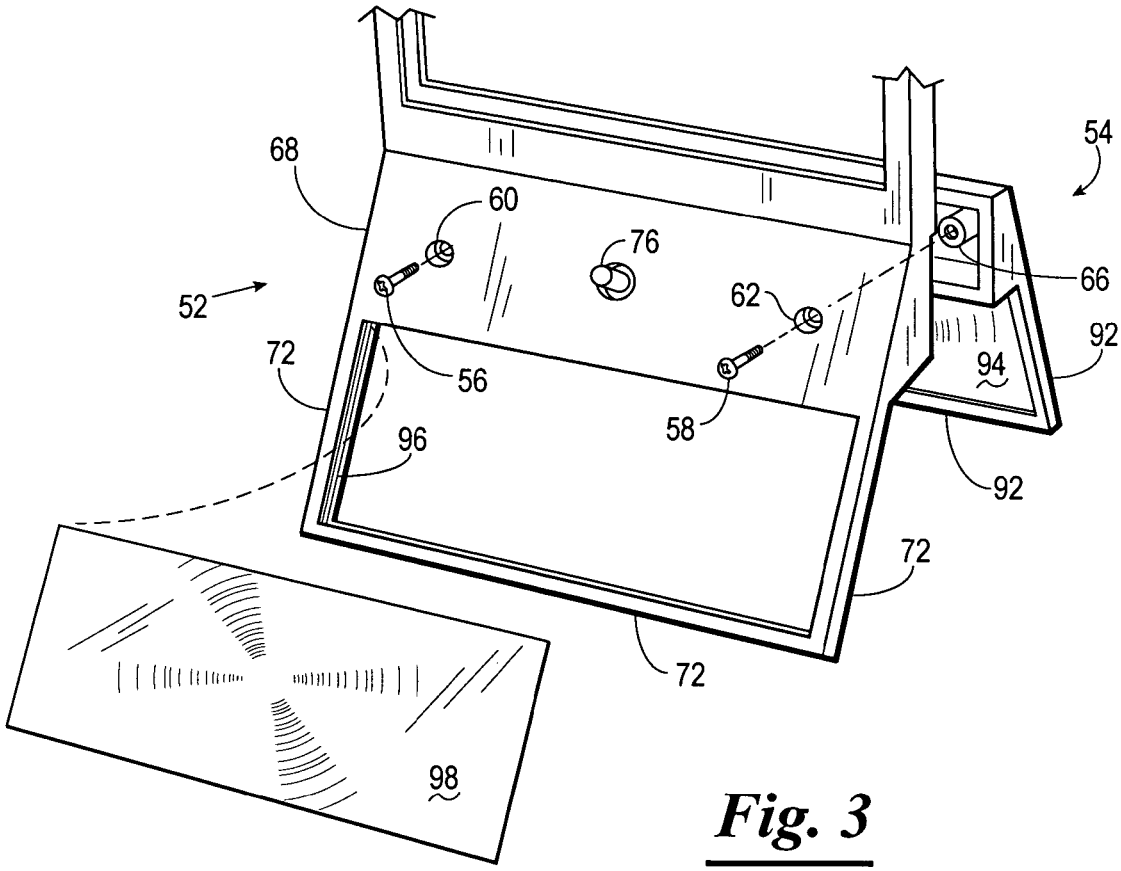
FIG. 3 is a view of the shorter of the two mating sections shown in FIG. 2.
Figure 4:
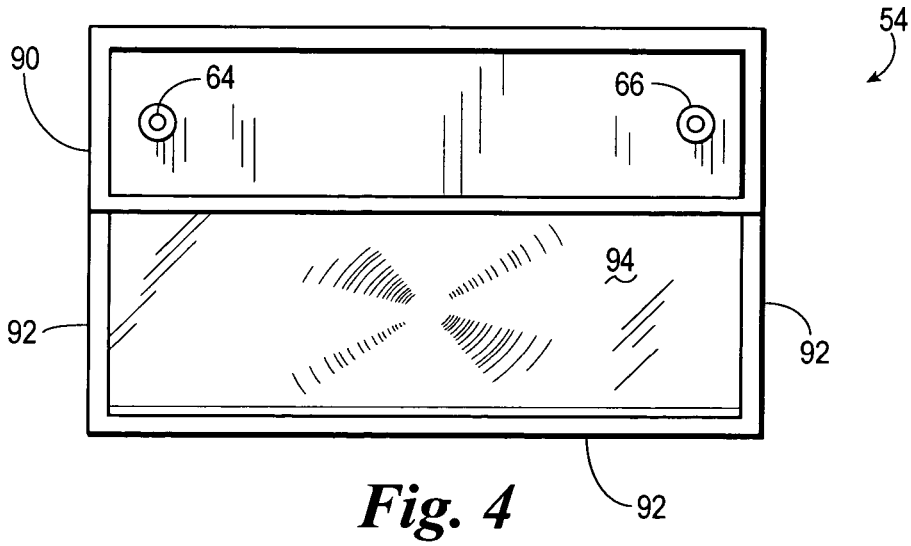
FIG. 4 is a view of the taller of the two mating sections shown in FIG. 2.

Referring now to FIG. 3, a ledge 96 in the frame 72 in the lower portion 68 of the taller section 52 receives a removable fresnel lens 98.

It will be understood by one skilled in the art that the fresnel lens 94 can be molded simultaneously with the frame 92 and the upper portion 90 of the shorter section 54. In the alternative, the upper portion 90 and the frame 92 can be molded in a single operation, followed by insertion of the removable fresnel lens 98 in the frame 92. Simultaneous molding of the fresnel lens together with the frame 92 and the upper portion 90 results in a significant cost reduction.

It will be further understood by one skilled in the art that the fresnel lens 74 can be molded in a single operation with the remainder of the taller section 52 or, in the alternative, a fresnel lens can be attached to the frame 72 in a second operation.

Referring now to FIG. 5, the switch 76 is viewed from the back side of the taller section 52. The lamp 78 is powered by a battery 100 when the lamp circuit is switched on.

Figure 6:
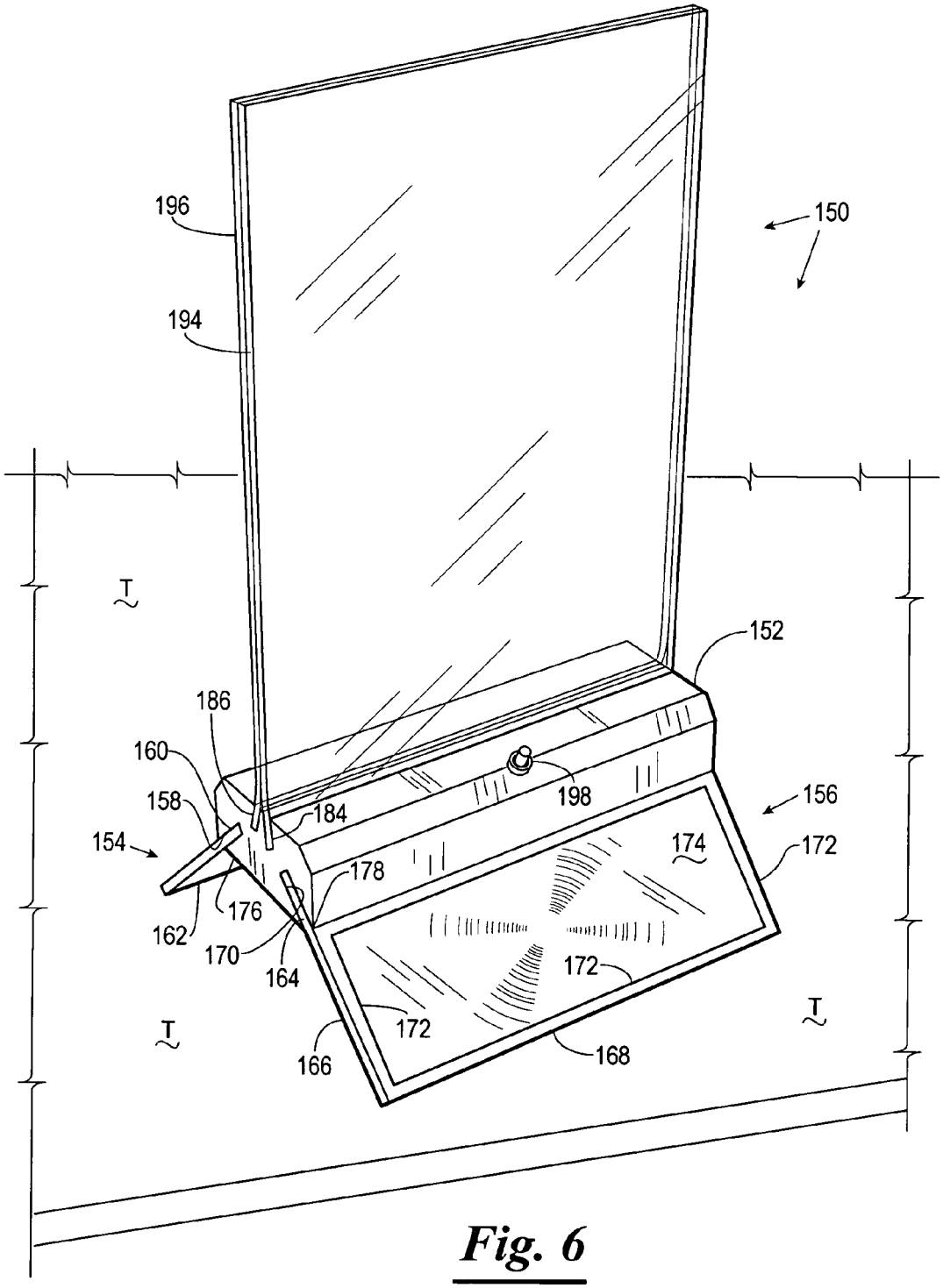
FIG. 6 shows another advertising support with illuminated magnifier according to the present invention.
Figure 7:
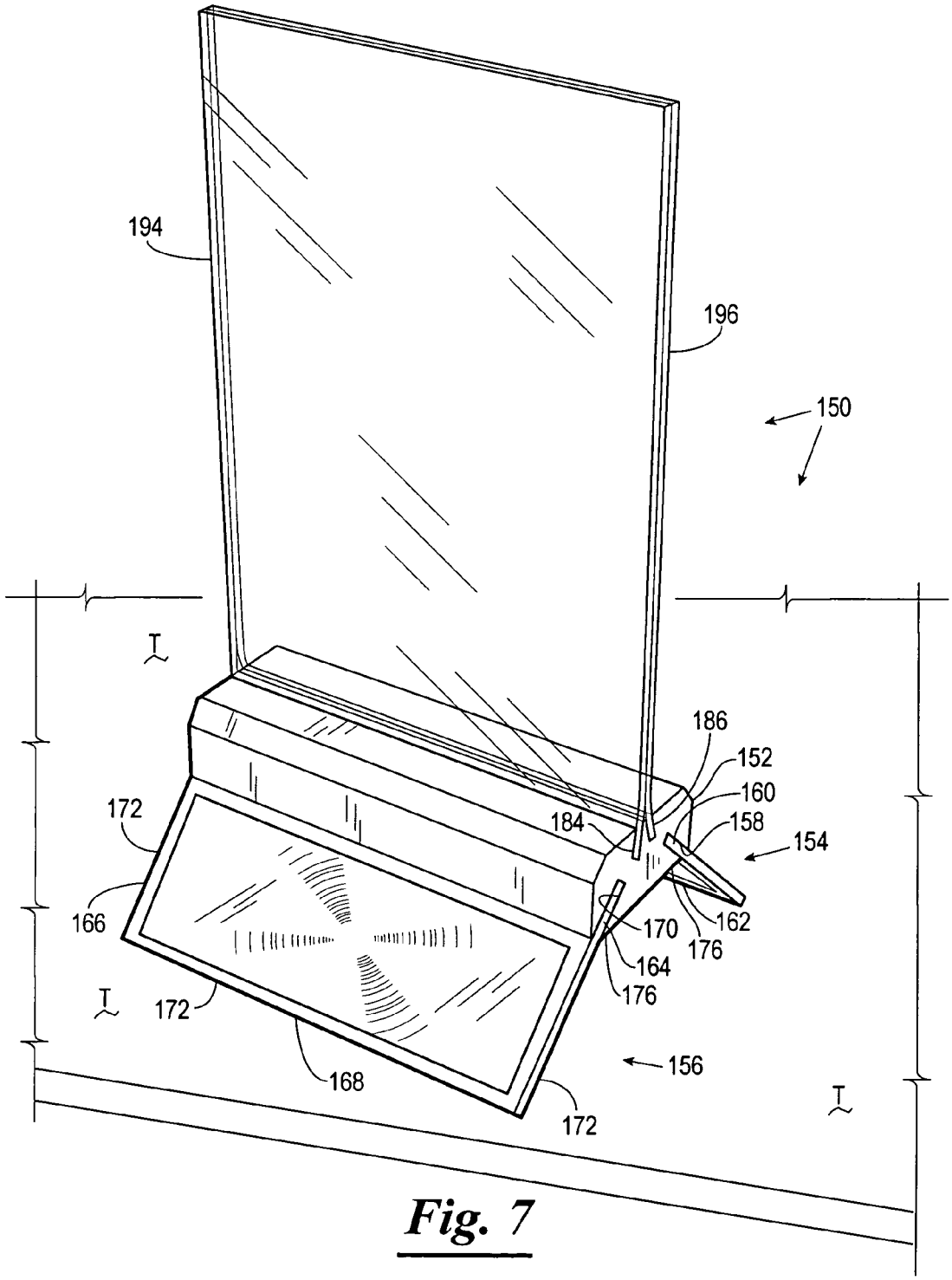
FIG. 7 is another view of the table topper shown in FIG. 6.
Figure 8:
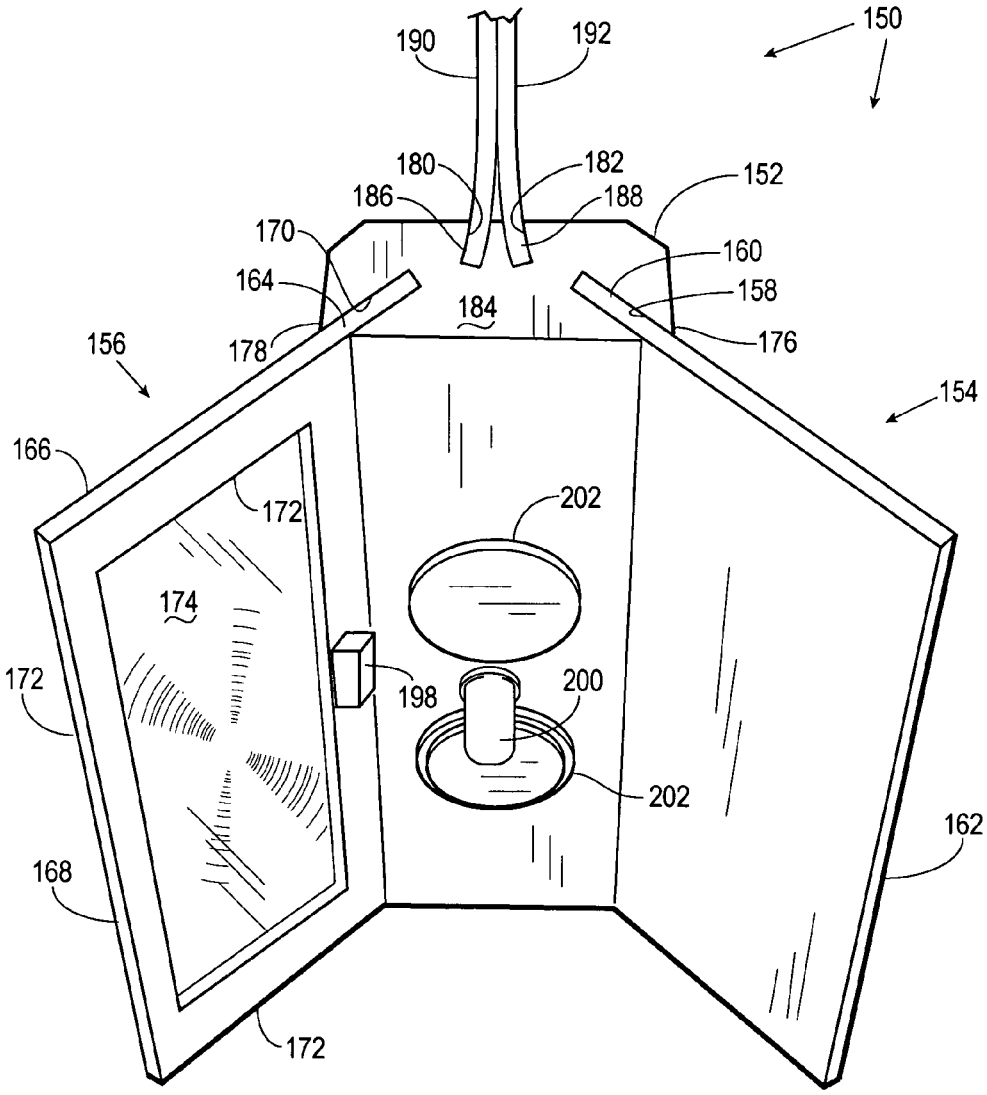
FIG. 8 is a bottom view of the table topper shown in FIG. 6.

Referring now to FIGS. 6–8, another table topper 150 according to applicant's invention includes a junction block 152 supported by leg member 154 and magnifying leg member 156. The upper portion 158 of the leg member 154 is press fit into a slot 160 in the junction block 152, and the lower edge 162 of the leg member 154 rests on the table top T. The magnifying leg member 156 has an upper portion 164, a lower portion 166, and a lower edge 168. The upper portion 164 of the magnifying leg member 156 is press fit into a slot 170 in the junction block 152. The lower portion 166 of the magnifying leg member 156 includes a frame portion 172. A molded fresnel lens 174 is attached to the frame portion 172 of the magnifying leg member 156.

Still referring to FIGS. 6–8, the slots 160, 170 are cut at an angle in the outside bottom edge portions 176, 178, respectively of the junction block 152 so that the lower edges 162, 168 of the leg member 154 and the magnifying leg member 156, respectively, flare outwardly down and away from the junction block 152 to provide a stable base of support for the table topper 150.

As best seen in FIG. 8, slots 180, 182 in the top center portion 184 of the junction block 152 receive the bottom portions 186, 188 respectively of vertical panes 190, 192. The bottom portions 186, 188 are frictionally biased within the slots 180, 182, respectively. The slots 180, 182 are angled upwardly toward each other so that, when inserted into the slots 180, 182, the upper portions 194, 196 of the vertical panes 190, 192 are pressed together so that a card or paper containing information (not shown) inserted between the vertical panes 190, 192 is held firmly in place.

Referring now to FIGS. 6 and 8, a switch 198 activates a lamp 200 powered by a batteries 202.

It will be understood by one skilled in the art that, while the junction block 152 shown in FIGS. 6–8 is depicted as a more-or-less rectangular cube, the junction block 152 can be spherical or any other particular shape permitting attachment of the leg member 154, the magnifying leg member 156, the vertical panes 194, 196, the switch 198, the lamp 200, and the batteries 202.

Figure 9:
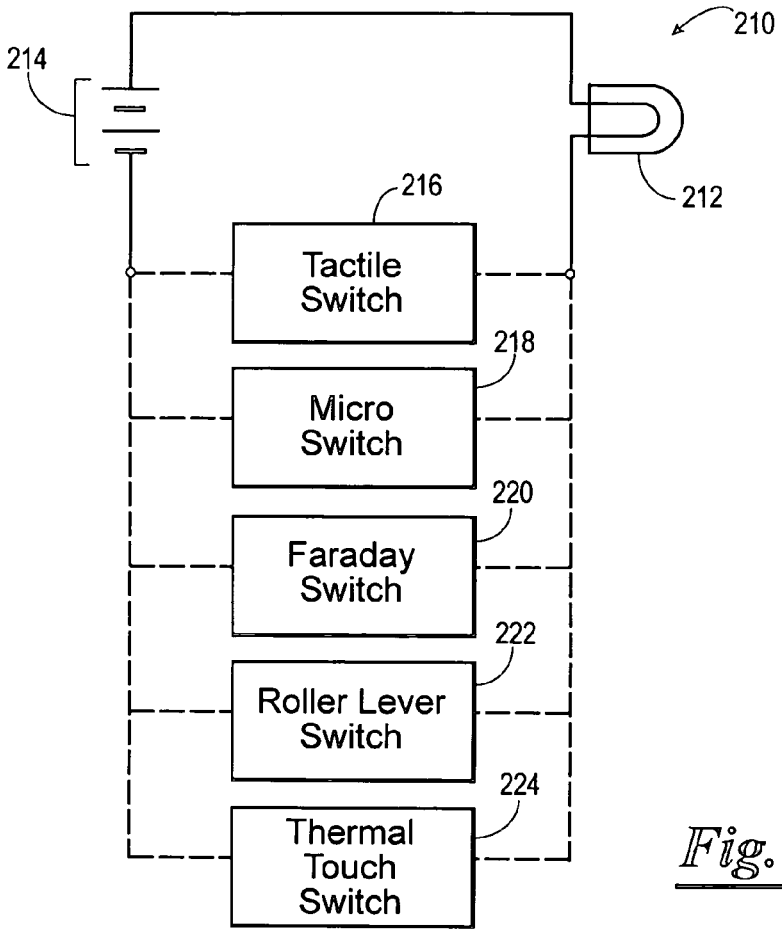
FIG. 9 is a stylized schematic of the battery-switch-lamp of the present invention.

Referring now to FIG. 9, a circuit diagram 210 shows a lamp 212 powered by a battery 214 actuated by, in the alternative, a tactile switch 216, a micro switch 218, a Faraday switch 220, a roller lever switch 222, or a thermal touch switch 224. Each switch set forth herein is known in the art and, therefore, will not be discussed in detail. Any type of switch can be used in applicant's Advertising Support with Illuminated Magnifier.

Figure 10:
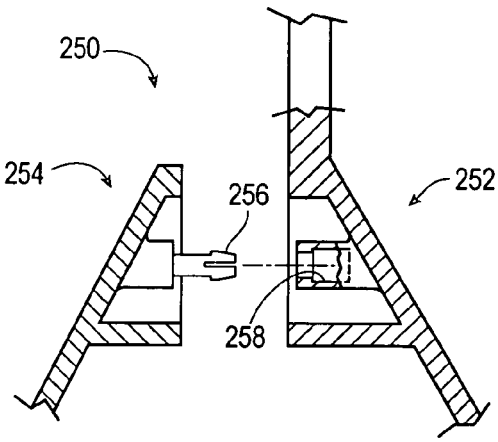
FIG. 10 is an enlarged cross-section, with a portion of the vertical advertising panel cut away, showing an alternate structure for the bottom portions of the two mating sections of the present invention.

Referring now to FIG. 10, another table topper 250 according to the present invention includes a taller section 252 and a shorter section 254. A split barbed projection 256 molded as part of the shorter section 254 mates with a shouldered receptacle 258 molded as part of the taller section 252 to secure the shorter section 254 to the taller section 252.

Figure 11:
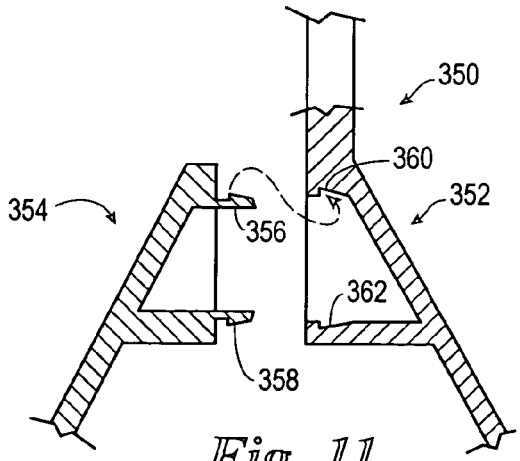
FIG. 11 is an enlarged cross-section, with a portion of the vertical advertising panel cut away, showing still another alternate structure for the bottom portions of the two mating sections of the present invention.

Referring now to FIG. 11, another table topper 350 according to the present invention includes a taller section 352 and a shorter section 354. Flat barbed projections 356, 358 molded as part of the shorter section 354 mate with detents 360, 362, respectively, molded as part of the taller section 352, to secure the shorter section 354 to the taller section 352.

Figure 12:
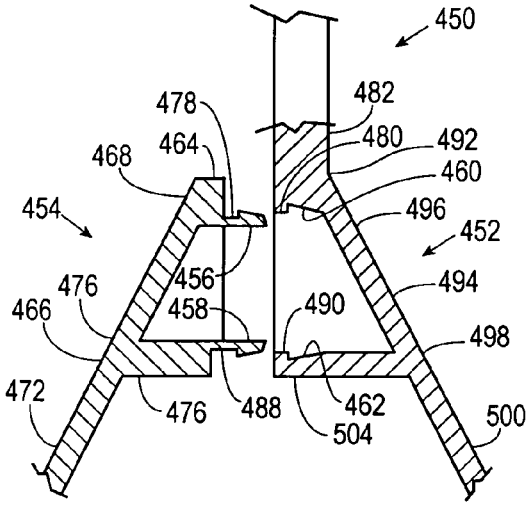
FIG. 12 is an enlarged cross-section, with a portion of the vertical advertising panel cut away, showing still another alternate structure for the bottom portions of the two mating sections of the present invention.
Figure 13:
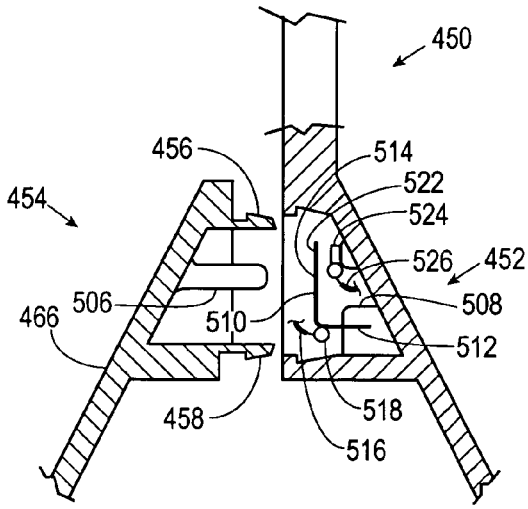
FIG. 13 is an enlarged cross-section, with a portion of the vertical advertising panel cut away, showing the structure of the device shown in FIG. 12 combined with a switch for activated the battery-powered lamp.

Referring now to FIGS. 12–13, another table topper 450 according to the present invention includes a taller section 452 and a shorter section 454.

Referring now to FIG. 12, a flat barbed projection 456 molded as a part of the shorter section 454 mates with a detent 460 molded as a part of the taller section 452. An extended flat barbed projection 458 molded as a part of the shorter section 454 mates with a detent 462 molded as a part of the taller section 452. The shorter section 454 includes a top ridge 464, a leg member 466 having an upper portion 468, an intermediate portion 470, and a lower portion, 472, and a lower edge 474 (not shown; see 166 and 168 in FIGS. 6–8). A horizontal member 476 located adjacent the intermediate portion 470 of the shorter section leg member 466 terminates in the extended flat barbed projection 458. The flat barbed projection 456 projects horizontally from the shorter section leg member 466 adjacent the upper portion 468 of the shorter section leg member 466 just below the top ridge 464.

Still referring to FIG. 12, the flat barbed projection 456 includes a recess 478. The mating detent 460 includes a shoulder 480. When the shorter section 454 and the taller section 452 are assembled, the recess 478 snugly receives the shoulder 480 of the mating detent 460.

Still referring to FIG. 12, the extended flat barbed projection 458 includes an elongated recess 488. The mating detent 462 has a shoulder 490. When the shorter section 454 and the taller section are assembled, the elongated recess 488 loosely receives the shoulder 490 of the mating detent 462.

Still referring to FIG. 12, the taller section 452 includes a junction region 492, a leg member 494 having an upper portion 496, an intermediate portion 498, and a lower portion 500, and a lower edge 502 (not shown). A horizontal member 504 located adjacent the intermediate portion 498 of the taller section leg member 494 terminates in the detent 462 to receive the extended flat barbed projection 458. The detent 460 is located adjacent the upper portion 496 of the taller section leg member 494 to receive the flat barbed projection 456. The junction region 492 refers to the junction of the taller section leg member 494 with the upper portion 482 of the taller section 452.

Figure 14:
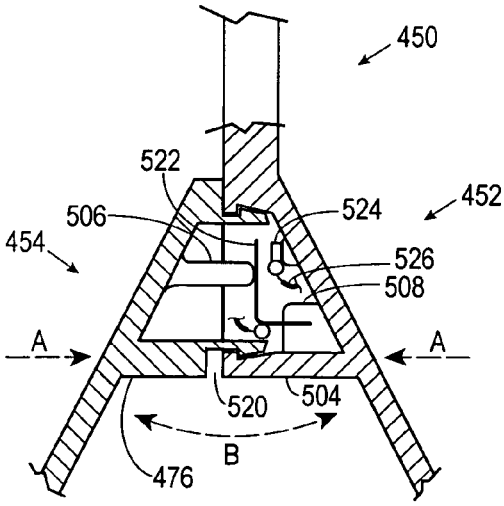
FIG. 14 is an enlarged cross-section, with a portion of the vertical advertising panel cut away, showing another configuration of a switch deployed between the two mating sections.

Referring now to FIGS. 13–14, a switch actuator 506 projects horizontally from the shorter section leg member 466 between the flat barbed projection 456 and the extended flat barbed projection 458 in the shorter section 454. An anchor block 508 molded into the taller section 452 supports an L-shaped conductive spring 510 having a short side 512 and a long side 514. An electrical lead 516 terminates at a terminal 518 in contact with the short side 512 of the L-shaped conductive spring 510. The long side 514 of the L-shaped conductive spring 510 is aligned with the switch actuator 506 when the taller section 452 is secured to the shorter section 454 as shown in FIG. 14 so that a gap 520 is created between portions of the mating extended flat barbed projection 458 and the mating detent 460. The free end 522 of the long side 514 of the L-shaped conductive spring 510 is aligned with a second terminal contact 524 attached to a second electrical lead 526.

Referring now to FIG. 14, as force is applied along A, the shorter section leg member 466 and the taller section leg member 494 move toward each other along B. The switch actuator 506 then contacts the second terminal contact 524 to close the electrical circuit and energize the lamp 200 (see FIGS. 6–8). As the force applied along A is removed, the L-shaped conductive spring 510 causes the shorter section leg member 466 and the taller section leg member 494 to move away from each other along B (and thereby opening the switched circuit).

Figure 15:
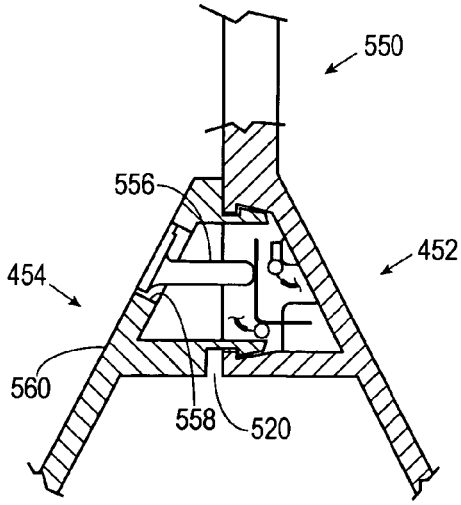
FIG. 15 is an enlarged cross-section, with a portion of the vertical advertising panel cut away, showing still another configuration of a switch deployed between the two mating sections.

Referring now to FIG. 15, another table topper 550 according to applicant's invention includes a taller section 452 and a shorter section 554. A removable switch actuator 556 is cemented in place within a cavity 558 in the leg member 560 of the shorter section 554. Otherwise, the table topper 550 show in FIG. 15 operates like the table topper 450 shown in FIGS. 12–14.

Figure 16:
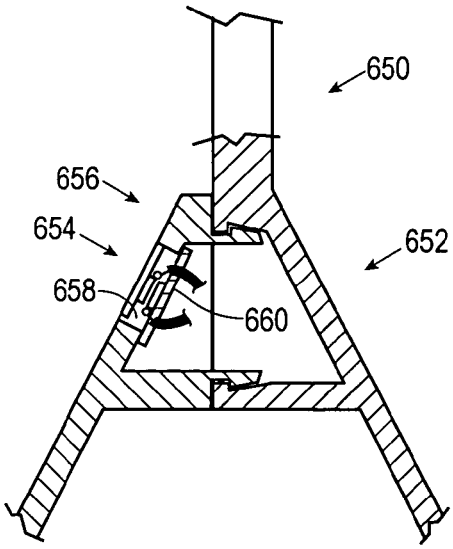
FIG. 16 is an enlarged cross-section, with a portion of the vertical advertising panel cut away, showing still another configuration of a switch deployed between the two mating sections.

Referring now to FIG. 16, another table topper 650 according to applicant's invention includes a taller section 652 and a shorter section 654. A touch switch 656 is deployed in a cavity 658 in the shorter section 654 and held in place by a backing plate 660.

Figure 17:
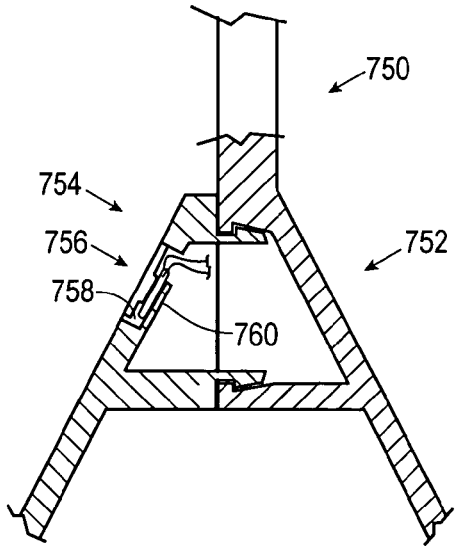
FIG. 17 is an enlarged cross-section, with a portion of the vertical advertising panel cut away, showing still another configuration of a switch deployed between the two mating sections.

Referring now to FIG. 17, another table topper 750 according to applicant's invention includes a taller section 752 and a shorter section 754. A touch switch 756 is deployed in a cavity 758 in the shorter section 754 and held in place by a tab 760 integrally molded as part of the shorter section 754.

Figure 18:
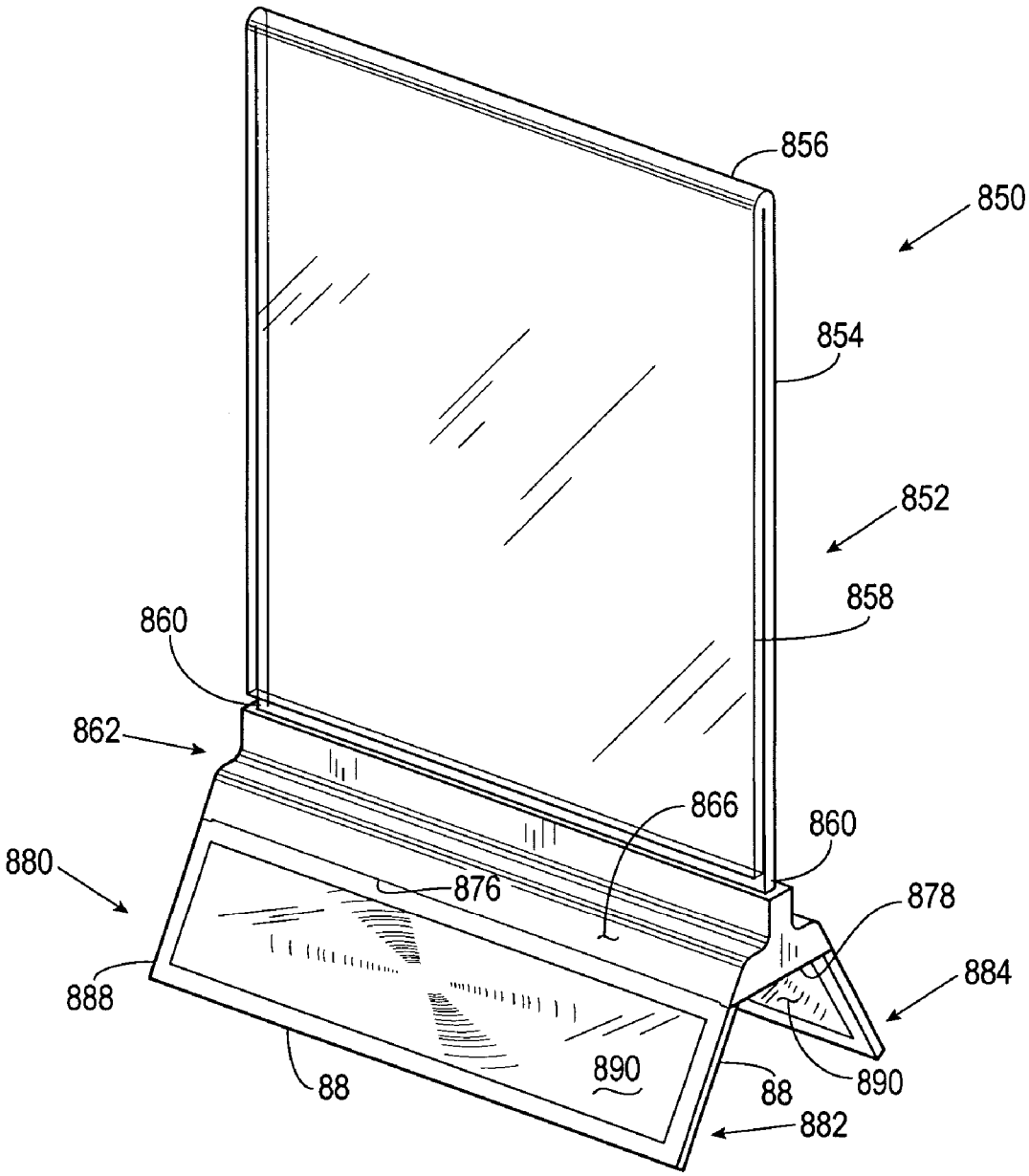
FIG. 18 shows another advertising support with illuminated magnifier according to the present invention.
Figure 19:
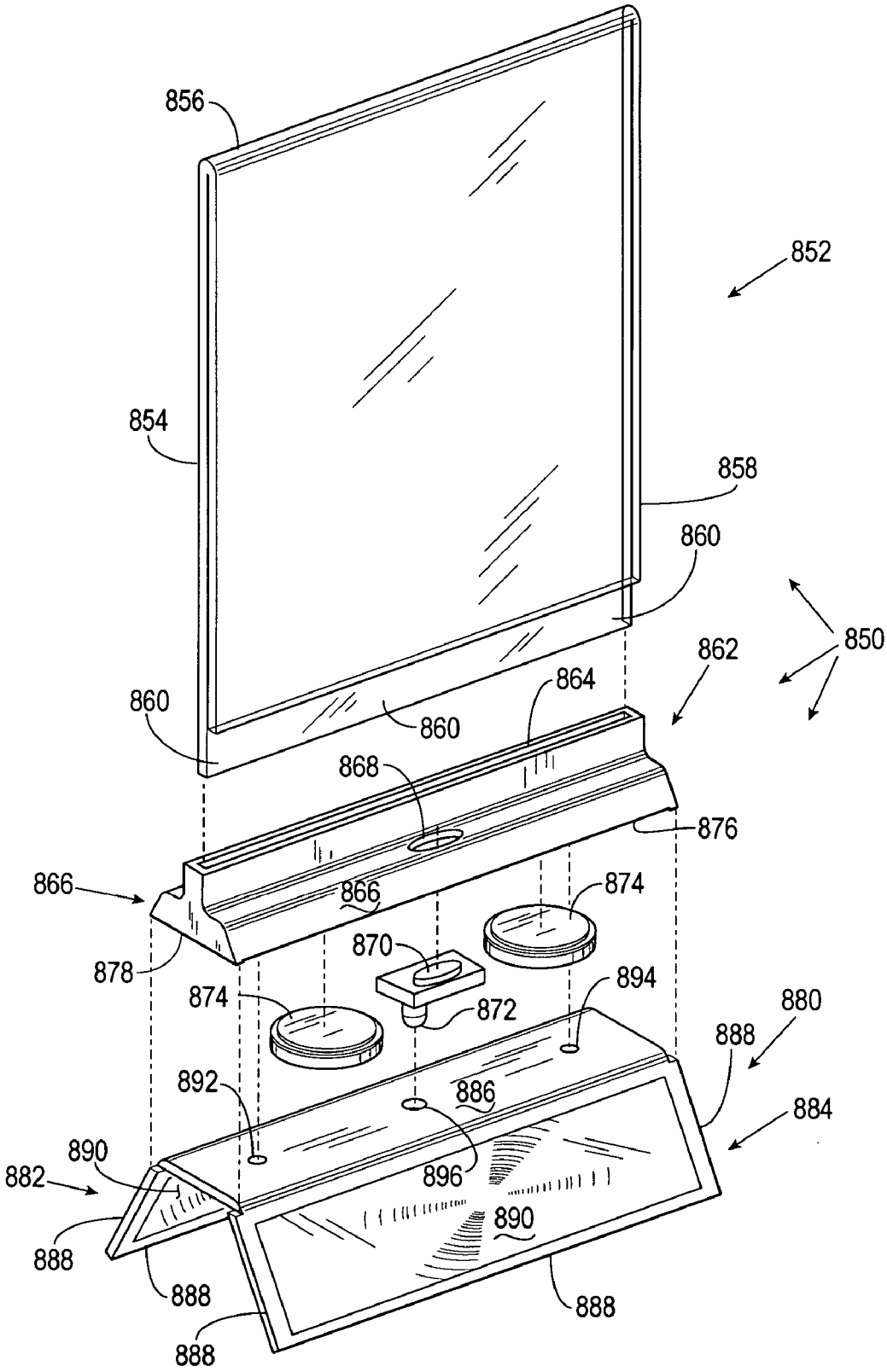
FIG. 19 is another view of the table topper shown in FIG. 18, wherein the structural elements are exploded vertically for ease of viewing.

Referring now to FIGS. 18–19, another table topper 850 according to applicant's invention includes a vertical foldover transparent display panel 852 having a longer section 854, a u-shaped fold 856, and a shorter section 858. The longer section 854 has a lower portion 860.

Still referring to FIGS. 18–19, a junction member 862 includes an integrally molded vertical slot 864 upstanding from a downwardly flared portion 866. The vertically upstanding slot 864 receives the lower portion 860 of the longer section 854 of the vertical foldover display panel 852. An aperture 868 in the downwardly flared portion 866 receives a switch 870 connected in series with a lamp 872 and batteries 874. The downwardly flared portion 866 terminates in parallel sided edges 876 and parallel end edges 878.

Still referring to FIGS. 18–19, a base 880 has two leg members 882, 884 connected by a horizontal rectangular section 886. Each leg member 882, 884 includes a frame 888 and a molded fresnel lens 890. The horizontal rectangular section 886 has apertures 892, 894 for routing electrical connectors and a lamp aperture 896. When the table topper 850 is assembled as shown in FIG. 18, the lamp 872 protrudes thorugh the lamp aperture 896 to light the check or or sales slip placed in the area between the leg members 882, 884 for viewing through at least one of the fresnel lenses 890.

Still referring to FIGS. 18–19, the horizontal rectangular section 886 terminates in parallel sided edges 898 and parallel end edges 900. As shown more clearly in FIG. 19, the parallel side edges 898 of the horizontal rectangular section 886 engage the parallel side edges 876 of the flared portion 866 of the junction member 862. Likewise, the parallel end edges 900 of the horizontal rectangular section 886 engage the parallel end edges 878 of the flared portion 866 of the junction member 862.

Figure 20:
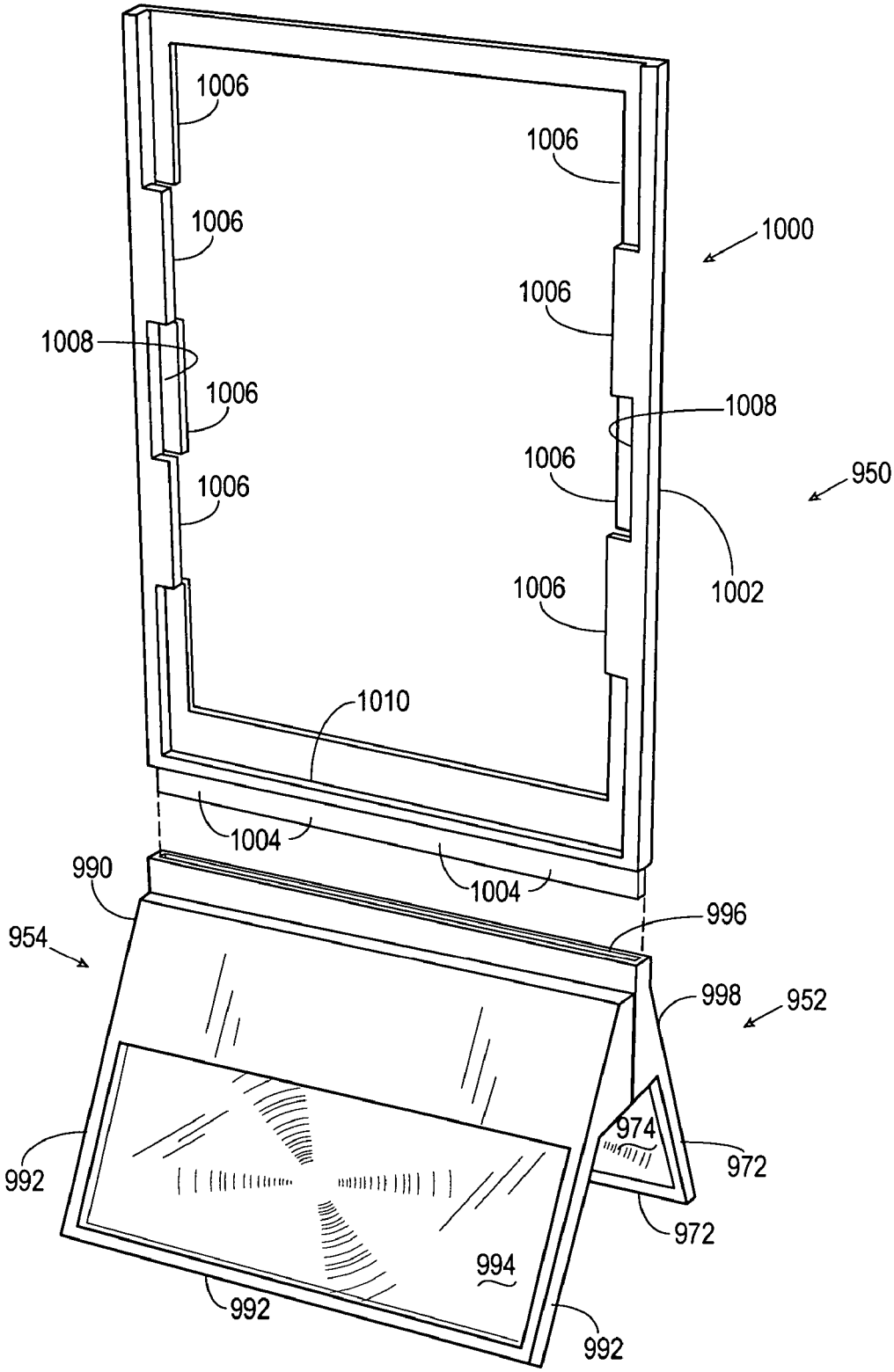
FIG. 20 is a view of another advertising support table topper according to the present invention.

Referring now to FIG. 20, another table topper 950 according to applicant's invention is shown. A first leg member 952 mates with a second leg member 954 (see FIGS. 1–15 for mating details) to form a base. The first leg member 952 includes a frame 972 and a fresnel lens 974 within the frame 972. The second leg member 954 includes a frame 992 and another fresnel lens 994 within the frame 992.

Still referring to FIG. 20, the first leg member includes an integrally molded vertical slot 996 upstanding from a top portion 998 of the first leg member 952. A vertical display member 1000 includes an upper frame portion 1002 for holding advertising or informational material (not shown) and a tongue 1004. When assembled for use, the tongue 1004 is inserted in the vertical slot 996 and secured by frictional bias between the tongue 1004 and the structure forming the vertical slot 996. Staggered opposing tabs 1006 in the upper frame portion 1002 of the vertical display member 1000 cooperate to form a pair of vertically aligned elongated slots 1008. The vertically aligned elongated slots 1008 are adapted to receive advertising or other informational material to be displayed in the table topper 950. A bottom rail 1010, essentially co-planar with the vertically aligned elongated slots 1008, supports the advertising or other material.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

I claim:

1. A table-top advertising support with illuminated magnifier, comprising:

a taller section comprising:

a lower portion housing a fresnel lens disposed within a frame in said lower portion, a lamp disposed in an aperture in said lower portion, a switch attached to said lower portion wherein said switch is connected in series with said lamp, and at least one battery attached to said lower portion wherein said battery is connected in series with said lamp and said switch; and an upper portion having vertically aligned elongated slots formed by cooperation of staggered opposing tabs;

a shorter section comprising:

an upper portion; and a fresnel lens disposed within a frame; and attachment means for attaching said taller section to said shorter section.

2. The device of claim 1 wherein said attachment means further comprises at least one screw disposed in a bore in said taller section, said at least one screw engaging a mating bore in said shorter section.

3. The device of claim 1, wherein said attachment means further comprises a split barbed projection molded as part of said shorter section, said split barbed projection mating with a shouldered receptacle molded as part of said taller section.

4. The device of claim 1, wherein said attachment means further comprises an upper flat barbed projection molded as part of said shorter section and a lower flat barbed projection molded as part of said shorter section, said upper barbed projection mating with an upper detent molded as part of said taller section and said lower flat barbed projection molded as part of said taller section.

5. The device of claim 1, wherein said switch is a tactile switch.

6. The device of claim 1 wherein said switch is a micro switch.

7. The device of claim 1, wherein said switch is a Faraday switch.

8. The device of claim 1, wherein said switch is a roller lever switch.

9. The device of claim 1 wherein said switch is a thermal touch switch.

10. The device of claim 1 wherein said lamp is a bright white LED.

11. The device of claim 1 wherein said lamp is an incandescent bulb.

12. The device of claim 1 wherein said lamp is a halogen lamp.

13. A table-top advertising support with illuminated magnifier (also referred to as a table topper), comprising:

a junction block having an upper portion and a lower portion, said lower portion having a first slot and a second slot, said first and second slots being directed outwardly from said lower portion of said junction block, said upper portion of said junction block having a first upwardly angled slot and a second upwardly angled slot;

a leg member having an upper portion, a lower portion, and a lower edge, said upper portion of said leg member being press fit into said first slot;

a magnifying leg member having an upper portion, a lower portion, and a lower edge, said upper portion of said magnifying leg member being press fit into said second slot, so that the leg member and the magnifying leg member flare outwardly down and away from said junction block so the lower edge of said leg member and the lower edge of said magnifying leg member rest on the table and form a stable base of support for the table topper;

a lamp-switch-battery assembly attached to said bottom portion of said junction block;

a first vertical pane having a bottom portion and an upper portion;

a second vertical pane having a bottom portion and an upper portion;

wherein said bottom portion of said first vertical plane is frictionally biasedly received in said first upwardly angled slot in said upper portion of said junction block and said bottom portion of said second vertical pane is frictionally biasedly received in said second upwardly angled slot, so that the upper portions of said vertical panes are pressed together to hold a card or paper containing information inserted between said first vertical pane and said second vertical pane; and wherein actuation of said switch energizes said lamp and illuminates the area beneath and between said leg member and said magnifying leg member.

14. The device of claim 13 wherein said lamp-switch-battery assembly includes two batteries connected in series.

15. A table-top advertising support with illuminated magnifier (also referred to as a table topper), comprising:

a vertical foldover transparent display panel having a longer section, a u-shaped fold, and a shorter section 858, said longer section having a lower portion 860;

a junction member having an integrally molded vertical slot upstanding from a downwardly flared portion and a switch aperture in said downwardly flared portion, said downwardly flared portion terminating in parallel side edges and parallel end edges, said vertically upstanding slot frictionally biasedly receiving said lower portion of said longer section of said vertical foldover display panel;

a switch disposed in said aperture, said switch connected in series with a lamp and at least one battery, said switch-lamp-battery assembly attached to said junction member;

a first leg member connected to a second leg member by a horizontal rectangular section, said horizontal rectangular section having at least one electrical connector aperture for routing electrical connectors related to said switch-lamp-battery assembly, said horizontal rectangular section terminated in parallel side edges and parallel end edges, at least one said leg member having a frame containing a molded fresnel lens;

wherein said parallel side edges of said horizontal rectangular section engage said parallel side edges of said flared portion of said junction member; and wherein said parallel end edges of said horizontal rectangular section engage said parallel end edges of said flared portion of said junction member.

16. The device of claim 15 wherein each said leg member has a frame containing a molded fresnel lens.

17. A table-top advertising support with illuminated magnifier (also referred to as a table topper), comprising:

a first leg member having a frame and a fresnel lens within said frame, said first leg member having an integral molded vertically upstanding slot;

a vertical display member having an upper frame portion for holding advertising or informational material and a tongue, said tongue being frictionally biasedly received within said integral molded vertically upstanding slot, said upper frame portion of said vertical display member having staggered opposing tabs cooperatively forming a pair of vertically aligned elongated slots and a bottom rail essentially co-planar with said vertically aligned slots; and a switch-lamp-battery assembly attached to said first leg member.

* * * * *